United States Patent [19]

Sweers

[11] Patent Number: 4,951,431

[45] Date of Patent: Aug. 28, 1990

[54] CHIMNEY AND WALL FLASHING SYSTEM

[76] Inventor: Ronald L. Sweers, 6165 E. Atherton Rd., Burton, Mich. 48519

[21] Appl. No.: 390,233

[22] Filed: Aug. 7, 1989

[51] Int. Cl.[5] ..... E04D 1/36

[52] U.S. Cl. ..... 52/58; 52/60; 52/219

[58] Field of Search ..... 52/58, 59, 60, 61, 62, 52/63, 199, 218, 219

[56] References Cited

U.S. PATENT DOCUMENTS

| | | | |
|---|---|---|---|
| 1,411,352 | 4/1922 | Hawksworth | 52/60 |
| 2,121,372 | 1/1937 | Tucker | 52/62 |
| 2,822,763 | 1/1957 | Berg | 52/60 |
| 3,363,369 | 1/1968 | Miller . | |
| 3,871,145 | 3/1975 | Hatmaker . | |
| 4,570,943 | 2/1986 | Houseman et al. . | |
| 4,623,171 | 11/1986 | Wilson . | |
| 4,635,409 | 1/1987 | Vandemore | 52/219 X |

FOREIGN PATENT DOCUMENTS

| | | | |
|---|---|---|---|
| 2132749 | 1/1973 | Fed. Rep. of Germany | 52/58 |

OTHER PUBLICATIONS

Lead Development Assoc., *Lead Flashings, Weatherings, and Roofings,* p. 15, Copyright 1958.

*Primary Examiner*—Carl D. Friedman
*Assistant Examiner*—Linda J. Hoffert
*Attorney, Agent, or Firm*—Gifford, Groh, Sprinkle, Patmore and Anderson

[57] ABSTRACT

A prefabricated roof flashing system for weatherproofing the intersection of an upright wall or a chimney structure and an includined shingled roof. The flashing system includes one or more inclined segments, one or more transverse segments and one or more corner segments. The system may either be applied at the intersection of a chimney and an inclined roof, or may be applied at the intersection of an upright wall and an inclined roof. The inclined segment includes sub-segments interfittable between shingles to form a weathertight seal therewith. The inclined segment may either be composed of aluminum sub-segments or plastic sub-segments. The inclined segment may be an extruded, one-pieced segment having been folded over onto itself and fastened.

22 Claims, 3 Drawing Sheets

CHIMNEY AND WALL FLASHING SYSTEM

BACKGROUND OF THE INVENTION

I. Field of the Invention

The present invention relates generally to chimney and roof flashing. More particularly, the present invention relates to a system of flashing for securely weatherproofing the intersection of an upright wall or a chimney structure and an inclined shingled roof.

II. Description of the Relevant Art

The tendency of water from rain or snow to seep into every available crack or crevice of a shingled roof is a scourge which has afflicted many an unfortunate home or office dweller. This problem is particularly acute at the intersection of an inclined roof slope and an upright wall or chimney structure. Water tends to seep down along the upright wall or chimney structure, bypassing the roof, and finding its way along the rafters and interior ceilings. The damage resulting from such seepage may be severe, and often results in rotted wood or damaged plaster or plasterboard. Repair costs of these elements of a structure are high.

Conventional responses to such seepage previously include the adaptation of aluminum sheet metal, known as "flashing", to the intersected areas. This flashing is fitted to the joints and angles before the shingles are installed. Conventional flashing is L-shaped in cross section. The horizontal part of the flashing is nailed by means of roofing nails to the wood on a roof before the shingles are applied.

The vertical part of the flashing may be attached to the upright wall or chimney structure by a tar-based adhesive. Alternatively, the mortar from mortar joints between selected bricks may be chipped away, and a small horizontal lip atop the vertical part of the flashing may be inserted into the crevice created by the chipping. With the flashing thus in place, the chipped-away mortar is replaced with fresh mortar or a sealant.

While this conventional approach is commonly used, it suffers from well-known disadvantages. Perhaps the most important of these is that in spite of the great effort of the roofer to provide an effective seal, the capillary action of water almost invariably draws the water along the crevice remaining between the edge of the overlaid shingles and the flashing. Here water is not directed away because unlike the shingles which are overlapping, the flashing of the inclined intersection allows the water to seep therealong, eventually finding its way under the shingles and into the wood.

Conventional methods of applying flashing also suffer from the difficulty associated with applying the vertical part to the upright wall or chimney structure. If a sealant is used, the seal formed thereby is almost always imperfect, thus allowing water seepage. If the mortar is chipped away, great damage may result to all of the associated mortar joints. In any event this approach is very tedious and time consuming and ultimately may also allow water seepage. Even where the two above-described methods of fastening the vertical part to the brickwork are employed together, the seepage of water is still not necessarily prevented.

Accordingly, the prior approaches to solving the problem of providing an effective and convenient flashing system have failed to eliminate the inconvenience and seepage conventionally associated therewith.

SUMMARY OF THE PRESENT INVENTION

The present invention provides a prefabricated roof flashing system for weatherproofing the intersection of an upright wall or a chimney structure and the slope of an inclined shingled roof. The flashing system includes one or more inclined segments, one or more transverse segments and one or more corner segments. The system may either be applied at the joints and angles created at the intersection of a chimney and an inclined roof, or may be applied at the intersection of an upright wall and the slope of an inclined roof.

The inclined segment includes sub-segments interfittable between shingles to form a weathertight seal therewith. The inclined segment may either be composed of aluminum sub-segments or plastic sub-segments. Alternatively, the inclined segment may be an extruded, one-pieced segment comprising a number of sub-segments interconnected by intermediate portions, whereby the sub-segments are folded onto one another and fastened together to form the inclined segment.

In addition, the inclined segment may be a molded, ready-to-use, one-pieced segment whereby the sub-segments define a number of partially overlapping horizontal flanges for accomodating overlapped shingles.

To fasten the vertical part to the upright wall or chimney, the upper edge of the vertical part is slightly angled away from the plane of the vertical part and over the horizontal part so that a trough is created when the inclined segment is abutted against an upright wall or chimney structure. Thereafter, a weatherproof sealing compound is placed in the trough for the filling thereof, and a tight, waterproof seal is formed thereby.

Of course, when the flashing system according to the present invention is fitted to a chimney structure, two inclined segments are used, one each placed on either side of the chimney, two transverse segments are used, one on either end, and four corner segments are used. When so applied, each of the segments have the angled upper edge to create a sealing trough.

Conversely, where an upright wall meets the slope of the inclined roof, only a single long strip of the inclined segment is required.

The above and other objects, advantages and features of the present invention will become more apparent from the following detailed description when read in conjunction with the accompanying drawing.

DETAILED DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS OF THE PRESENT INVENTION

Figure 1:
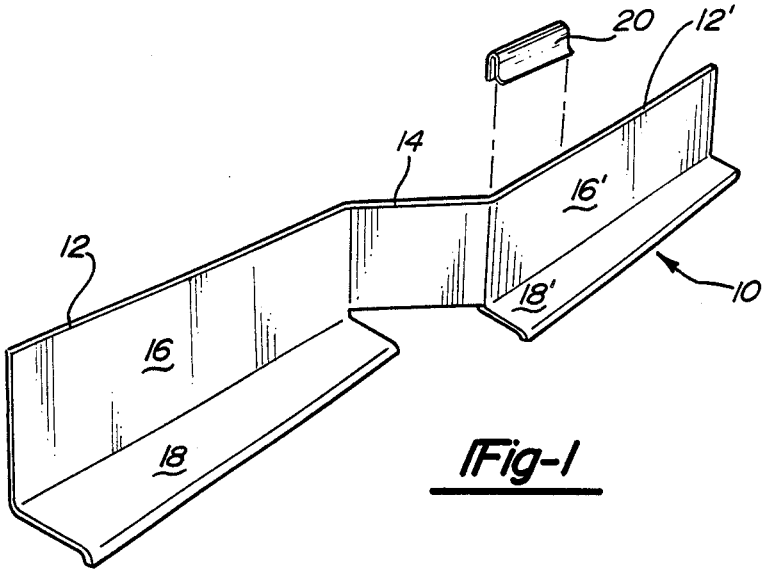
FIG. 1 is a perspective view of a preferred embodiment of the present invention in its unfolded state.

The drawing discloses preferred embodiments of the present invention. While the configurations according to the illustrated embodiments are preferred, it is envisioned that alternate configurations of the present invention may be adopted without deviating from the invention as portrayed. The preferred embodiments are discussed hereafter.

With reference to FIG. 1, a preferred embodiment of an inclined segment, generally illustrated as 10, is provided. According to this embodiment, the inclined segment 10 is for placement along the sloping intersected point where an upright wall or chimney structure and an inclined roof intersect.

The inclined segment 10 comprises at least two sub-segments 12, 12' interconnected by an intermediate part 14. Each of the sub-segments 12, 12' includes a vertical portion 16, 16' and a horizontal portion 18, 18'.

The inclined segment 10 according to this embodiment is formed from an extruded piece of a continuous polymerized strip such as a plastic or a vinyl. The segment 10 is flexible to allow for the bending and subsequent overlapping of sub-segment 12' over sub-segment 12 as illustrated in FIG. 2.

Still referring to FIG. 1, a fastener 20 is illustrated. According to the present embodiment, the fastener 20 is a clasp fastener, although it is envisioned that other types of fasteners may be effectively employed.

Figure 2:
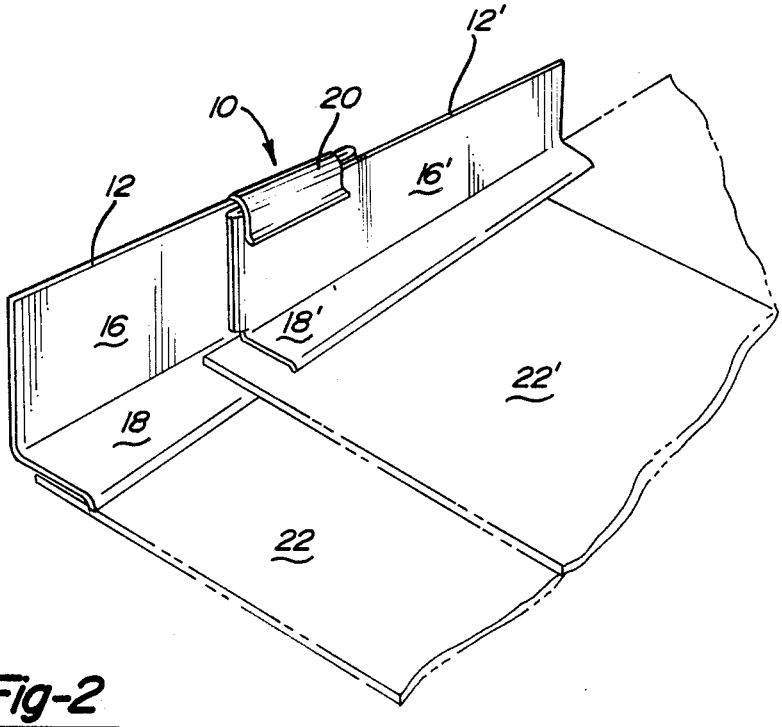
FIG. 2 is a perspective view of the embodiment of FIG. 1 depicting an inclined segment overlapped and interfitted with shingles.

Referring to FIG. 2, the inclined segment 10 is illustrated in its relationship to a number of shingles 22, 22'. The overlapping and overlapped relationship of the shingles 22, 22' and the sub-segments 12, 12' of the inclined segment 10 is illustrated. It is this overlapping-/overlapped relationship that successfully prevents water seepage by diverting water down and away from the flashing, thereby allowing the inclined segment 10 to function in a manner identical to the shingles 22, 22'. Because no gap is left between the flashing and the shingles as is the case with conventional flashing methods, water seepage and, hence, water damage is prevented.

Figure 3:
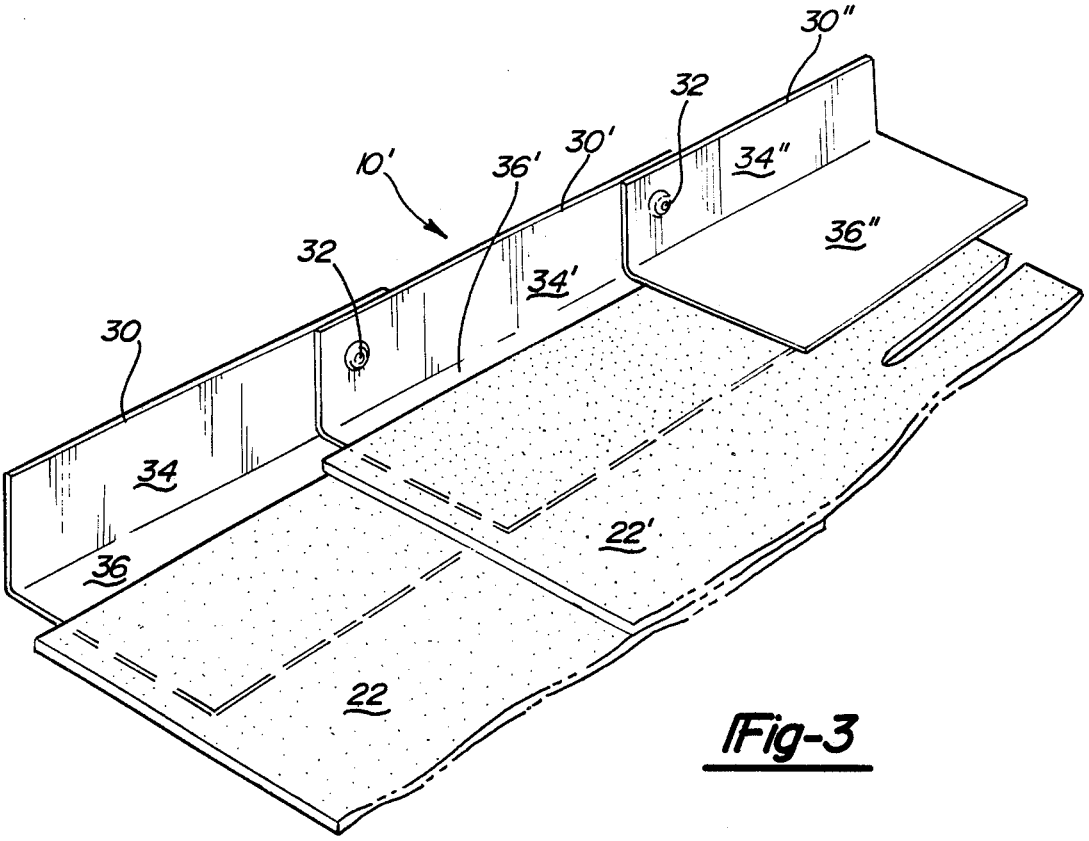
FIG. 3 is a perspective view of an alternate embodiment of the present invention illustrating its interrelationship with shingles.

FIG. 3 illustrates an alternate embodiment of the present invention showing an inclined segment illustrated generally as 10'. According to this embodiment, the inclined segment 10' is, like the embodiment discussed above with respect to FIGS. 1 and 2, composed of a number of sub-segments. However, unlike the embodiment disclosed in FIGS. 1 and 2, the inclined segment 10' illustrated in FIG. 3 is composed of a number of separate sub-segments 30, 30', 30'' which are produced individually and are connected to one another by means of a number of fasteners 32. The fasteners 32 may be rivets, screws or the like.

The sub-segments 30, 30', 30'' are preferably composed of aluminum, although they may be composed of a polymerized material such as a plastic or a vinyl.

Each sub-segment 30, 30', 30'' includes a vertical part 34, 34', 34'' and a horizontal part 36, 36', 36''.

According to the depiction of FIG. 3, the overlapping and overlapped relationship of the horizontal parts 36, 36', 36'' and the shingles 22, 22' can easily be understood. Specifically, the lowermost horizontal part 36 is overlapped by the shingle 22, which is partially overlapped by the next horizontal part 36'. The next horizontal part 36' is overlapped by the next shingle 22' which itself is overlapped by the next horizontal part 36'', and so on until the upright wall or chimney structure is fully protected by an inclined segment 10'.

Figure 4:
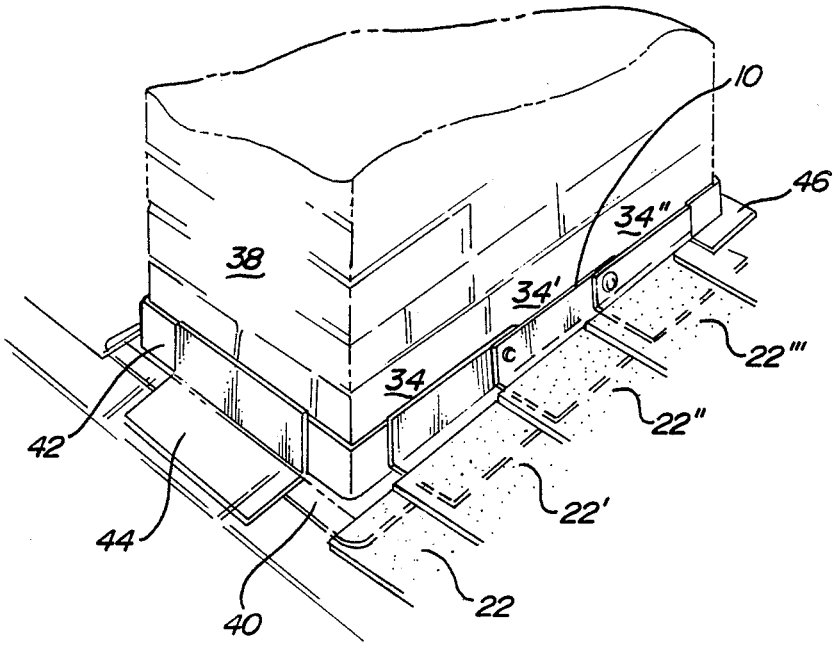
FIG. 4 is an expanded and more inclusive perspective view of the view of FIG. 3 illustrating the alternate embodiment in place on a chimney structure.

The application of the present invention may be more fully and completely understood by referring to FIG. 4. With reference thereto, the application of the present invention is begun by applying shingles from the eave of the roof until reaching the lower side of a chimney, illustrated as 38. A pair of lower corner segments 40, 42 are applied, followed by a lower transverse segment 44. Both of the lower corner segments 40, 42 and the transverse segment 44 may be composed of a polymerized material such as a plastic or a vinyl.

The shingling process is then continued toward the peak of the roof (not illustrated). Thereafter, the inclined segment 10' is fitted in place by carefully locating the shingles 22, 22', 22'', 22''' between the sub-segments 34, 34', 34''. The inclined segment 10' may be anchored by conventional fasteners such as roofing nails.

The two upper corner segments 46 (only one is visible) are next emplaced, followed lastly by an upper transverse segment (not visible) which is fitted to overlap the upper corner segments.

Figure 5:
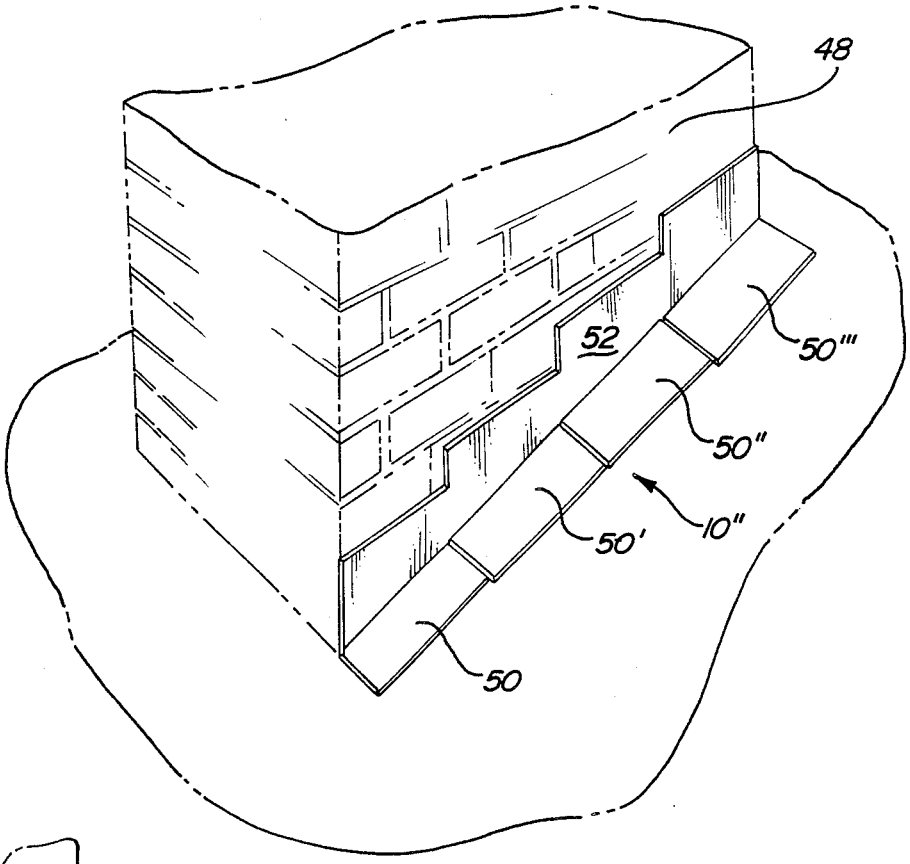
FIG. 5 is a perspective view of yet a further embodiment of the present invention shown in place on a chimney structure.

With reference to FIG. 5, a further embodiment of the present invention is thereshown. An inclined segment, generally illustrated as 10'', is shown in place on the side of a chimney structure 48. The inclined segment 10'' is also composed of a number of sub-segments 50, 50', 50'', 50'''. However, unlike the inclined segments 10 and 10' illustrated in FIGS. 1–4, the inclined segment 10'' of FIG. 5 is a one-pieced, ready-to-use molded segment. Instead of being folded over or fastened together, the sub-segments 50, 50', 50'', 50''' are really only segmented at their horizontal parts for interconnection with overlapping and overlapped shingles as discussed above with respect particularly to FIG. 4.

FIG. 5 also illustrates how the vertical part of the inclined segment 10'' (generally indicated as 52) may be cut to match the stepped fashion of the bricks to thereby suggest the appearance of conventional counterflashing which is created by the above-discussed conventional approaches to chipping out mortar. The inclined segment 10'' may be marked on its reverse side for cutting by the worker for securing a pleasing and harmonious appearance.

Figure 6:
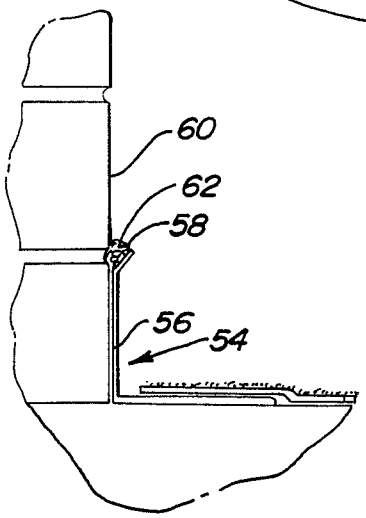
FIG. 6 is a side-elevational and cross-sectional view illustrating the sealing trough of a segment according to the present invention.

Referring lastly to FIG. 6, a side-elevational and cross-sectional view is depicted to illustrate the sealing trough of a segment according to the present invention.

The segment is illustrated generally as 54 and may be any one of the inclined, corner, or transverse segments above-discussed. The segment 54 includes a vertical part 56. The upper edge of the vertical part 56 is angled slightly away from the plane of the vertical part 56 to thereby create a trough 58 when the vertical part 56 is abutted against an upright wall or chimney structure 60. Within the trough 58 is provided an adhesive compound 62 such as a tar or other sealant to thereby prevent the seepage of water thereby. Of course, to provide additional water-proofing, sealant may be applied directly to the brick side of the vertical part 56 before being placed against the wall or chimney 60.

Having described my invention, however, many modifications thereto will become apparent to those skilled in the art to which it pertains without deviation from the spirit of the invention as defined by the scope of the appended claims.

I claim:

1. A prefabricated roof flashing system for weatherproofing the intersection of an upright wall or chimney structure and an inclined shingled roof, said flashing system including an inclined segment comprising a vertical portion and a plurality of serially and overlappingly interconnected horizontal portions, a shingle of said roof being fittable between each of the overlapped and overlapping portions;

said inclined segment comprises multiple sub-segments;

said sub-segments being flexibly interconnected by intermediate segments, whereby said intermediate segments allow said sub-segments to be substantially folded over onto each other in a serially overlapping manner.

2. A prefabricated roof flashing system according to claim 1 further including:

at least one transverse segment fittable at the intersection of said upright structure and the portion of said roof situated transversely with respect to the inclination of said roof; and at least one corner segment interconnecting said at least one inclined segment and said at least one transverse segment.

3. A prefabricated roof flashing system according to claim 1 wherein said inclined segment is composed of a polymerized material.

4. A prefabricated roof flashing system according to claim 3 wherein said inclined segment is a molded, ready-to-use structure.

5. A prefabricated roof flashing system according to claim 1 wherein said inclined segment comprises multiple sub-segments, whereby said vertical portion also comprises a plurality of serially and overlappingly interconnected vertical sub-portions.

6. A prefabricated roof flashing system according to claim 5 wherein said multiple sub-segments are independent components.

7. A prefabricated roof flashing system according to claim 6 wherein said sub-segments are fastened together to produce said inclined segment.

8. A prefabricated roof flashing system according to claim 7 wherein said sub-segments are composed of a metal.

9. A prefabricated roof flashing system according to claim 1 wherein said sub-segments are composed of a polymerized material.

10. A prefabricated roof flashing system for weatherproofing the intersection of an upright wall or chimney structure and an inclined shingled roof, said flashing system including an inclined segment comprising a vertical portion and a plurality of serially and overlappingly interconnected horizontal portions, a shingle of said roof being fittable between each of the overlapped and overlapping portions;

said inclined segment comprising multiple sub-segments, whereby said vertical portion also comprises a plurality of serially and overlappingly interconnected vertical sub-portions;

said sub-segments being composed of a polymerized material;

said sub-segments being flexibly interconnected by intermediate segments, whereby said intermediate segments allow said sub-segments to be substantially folded over onto each other in a serially overlapping manner.

11. A prefabricated roof flashing system according to claim 10 wherein said folded over, overlapping sub-segments are fastened together by fasteners.

12. A prefabricated roof flashing system according to claim 11 wherein said fasteners are U-shaped clips.

13. A prefabricated roof flashing system for weatherproofing the intersection of an upright wall or chimney structure and an inclined shingled roof, said flashing system including an inclined segment comprising a vertical portion and a plurality of serially and overlappingly interconnected horizontal portions, a shingle of said roof being fittable between each of the overlapped and overlapping portions;

said vertical portion including an upper edge, a lower edge, and an intermediate body, said upper edge being angled relative to said intermediate body, whereby a trough is formed between said upper edge and said upright wall or chimney structure when said upright portion is fitted thereto.

14. A prefabricated roof flashing system according to claim 13 wherein a weatherproof sealing compound is placable within said trough to form a weathertight seal between said upper edge and said upright wall or chimney structure.

15. A prefabricated roof flashing system for weatherproofing the intersection of an upright wall or chimney structure and an inclined shingled roof, said flashing system including:

at least one inclined segment having an upright portion having an upper multi-stepped edge portion and a lower edge portion and two ends;

a plurality of overlapped portions provided perpendicularly along said lower edge portion of said at least one inclined segment, said overlapped portions being selectively interfittable with shingles of said shingled roof;

at least one corner segment attachable to one of said two ends of said inclined segment; and at least one transverse segment having two ends, one of said two ends being attachable to said at least one corner segment.

16. A prefabricated roof flashing system according to claim 15 wherein said segments are composed of a polymerized material.

17. A prefabricated roof flashing system according to claim 16 wherein said segments are molded, ready-to-use structures.

18. A prefabricated roof flashing system according to claim 15 wherein said inclined segment comprises multiple sub-segments.

19. A prefabricated roof flashing system according to claim 16 wherein said sub-segments are independent components.

20. A prefabricated roof flashing system according to claim 19 wherein said sub-segments are fastened together to produce said inclined segment.

21. A prefabricated roof flashing system for weatherproofing the intersection of an upright wall or chimney structure and an inclined shingled roof, said flashing system including:

at least one inclined segment having two ends and having multiple overlapped portions selectively interfittable with shingles of said shingled roof;

at least one corner segment attachable to one of said two ends of said inclined segment; and at least one transverse segment having two ends, one of said two ends being attachable to said at least one corner segment;

said segments being composed of a polymerized material;

said sub-segments being independent components;

said sub-segments being fastened together to produce said inclined segments;

said sub-segments being flexibly interconnected by intermediate segments, whereby said intermediate segments allow said sub-segments to be substantially folded over onto each other in a serially overlapping manner.

22. A prefabricated roof flashing system for weatherproofing the intersection of an upright wall or chimney structure and an inclined shingled roof, said flashing system including:

at least one inclined segment fittable along the inclined intersection of an upright structure and an inclined roof;

said inclined segment including a vertical portion and a plurality of serially and overlappingly interconnected horizontal portions, a shingle of said roof being fittable between each of the overlapped and overlapping portions;

at least one transverse segment fittable at the intersection of said upright structure and the portion of said roof situated transversely with respect to the inclination of said roof; and at least one corner segment interconnecting said at least one inclined segment and said at least one transverse segment;

said inclined segment comprises multiple sub-segments;

said sub-segments being flexibly interconnected by intermediate segments, whereby said intermediate segments allow said sub-segments to be substantially folded over onto each other in a serially overlapping manner.

* * * * *